US010308021B2

(12) United States Patent
Nomura et al.

(10) Patent No.: US 10,308,021 B2
(45) Date of Patent: Jun. 4, 2019

(54) PRINT ELEMENT SUBSTRATE, PRINTHEAD, AND IMAGE FORMING APPARATUS

(71) Applicant: CANON KABUSHIKI KAISHA, Tokyo (JP)

(72) Inventors: Hiroyasu Nomura, Inagi (JP); Nobuyuki Hirayama, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/822,729

(22) Filed: Nov. 27, 2017

(65) Prior Publication Data

US 2018/0170051 A1 Jun. 21, 2018

(30) Foreign Application Priority Data

Dec. 16, 2016 (JP) ..... 2016-244537

(51) Int. Cl.
*B41J 2/14* (2006.01)
*B41J 2/045* (2006.01)

(52) U.S. Cl.
CPC ..... *B41J 2/14129* (2013.01); *B41J 2/0458* (2013.01); *B41J 2/04541* (2013.01); *B41J 2/04543* (2013.01); *B41J 2/04563* (2013.01); *B41J 2/14153* (2013.01); *B41J 2002/14354* (2013.01)

(58) Field of Classification Search
CPC ..... B41J 2/04541; B41J 2/14153; B41J 2/04563; B41J 2002/14354
See application file for complete search history.

(56) References Cited

U.S. PATENT DOCUMENTS 8,033,631 B2 10/2011 Kanno
2006/0125863 A1* 6/2006 Silverbrook ..... B41J 2/04505 347/14

(Continued)

FOREIGN PATENT DOCUMENTS

JP 2008-914 A 1/2008
JP 6265007 B 8/2013

OTHER PUBLICATIONS

U.S. Appl. No. 15/819,054, filed Nov. 21, 2017.
U.S. Appl. No. 15/646,791, filed Jul. 11, 2017.

*Primary Examiner* — Julian D Huffman
(74) *Attorney, Agent, or Firm* — Venable LLP

(57) ABSTRACT

A print element substrate that includes a plurality of heaters and a plurality of temperature sensors provided in correspondence with a plurality of nozzles, comprises: a selecting unit that selects one temperature sensor from the plurality of temperature sensors and output a temperature signal; a determining unit that determines a discharge state of the nozzle based on the temperature signal output by the selecting unit; an outputting unit that, based on a determination result output from the determining unit, externally outputs a signal indicating the discharge state of the nozzle corresponding to the selected temperature sensor; and a masking unit that, in accordance with a change in selection of the temperature sensor by the selecting unit, masks the determination result output from the determining unit to the outputting unit during a predetermined time from a timing of the change.

17 Claims, 9 Drawing Sheets

(56) References Cited

U.S. PATENT DOCUMENTS

| | | | | |
|---|---|---|---|---|
| 2007/0291081 | A1* | 12/2007 | Kanno | B41J 2/04541 347/61 |
| 2009/0309913 | A1* | 12/2009 | Oohashi | B41J 2/04563 347/17 |
| 2010/0315454 | A1 | 12/2010 | Kanno | |
| 2012/0306953 | A1* | 12/2012 | Kanno | B41J 2/0451 347/11 |
| 2013/0208037 | A1* | 8/2013 | Hirayama | B41J 2/04541 347/9 |

* cited by examiner

A - A SECTION

PRINT ELEMENT SUBSTRATE, PRINTHEAD, AND IMAGE FORMING APPARATUS

BACKGROUND OF THE INVENTION

Field of the Invention

The present invention relates to a print element substrate, a printhead, and an image forming apparatus.

Description of the Related Art

Out of inkjet printing methods of discharging ink from a nozzle and adhering it to a printing medium such as paper, a thermal inkjet printing method of discharging ink from a nozzle by thermal energy generated by a heater is known.

In an inkjet printing apparatus using this method, a method of using a driving pulse of a heater to change validation/invalidation of a temperature signal output from a temperature sensor provided in correspondence with the heater is proposed (see Japanese Patent No. 5265007). A discharge state determination method of judging whether the state of discharge from an ink nozzle is normal or abnormal by grasping a point (to be referred to as a feature point hereinafter) where a speed at which a temperature detected by a temperature sensor decreases changes rapidly is also proposed (see Japanese Patent Laid-Open No. 2008-000914).

In the related art, however, in synchronism with a timing of the driving pulse of the heater, while an output signal of the temperature sensor that is currently valid is invalidated, an output signal of the temperature sensor to be selected next is validated, generating discontinuous steps in the output signals. Then, in a process of checking whether the feature point occurs in a temperature drop stage of a temperature signal, a step portion may mistakenly be judged as a rapid temperature drop stage and erroneously recognized as the feature point if the steps are generated in a temperature drop direction, making it impossible to grasp the feature point accurately.

SUMMARY OF THE INVENTION

In order to solve the above-described problems, the present invention provides an arrangement capable of suppressing the influence of discontinuous steps in temperature signals when a temperature sensor is changed.

According to one aspect of the present invention, there is provided a print element substrate that includes a plurality of heaters and a plurality of temperature sensors provided in correspondence with a plurality of nozzles, the substrate comprising: a selecting unit configured to select one temperature sensor from the plurality of temperature sensors and output a temperature signal; a determining unit configured to determine a discharge state of the nozzle based on the temperature signal output by the selecting unit; an outputting unit configured to, based on a determination result output from the determining unit, externally output a signal indicating the discharge state of the nozzle corresponding to the temperature sensor selected by the selecting unit; and a masking unit configured to, in accordance with a change in selection of the temperature sensor by the selecting unit, mask the determination result output from the determining unit to the outputting unit during a predetermined time from a timing of the change.

According to another aspect of the present invention, there is provided a printhead that includes at least one print element substrate, wherein the print element substrate includes a plurality of heaters and a plurality of temperature sensors provided in correspondence with a plurality of nozzles, a selecting unit configured to select one temperature sensor from the plurality of temperature sensors and output a temperature signal, a determining unit configured to determine a discharge state of the nozzle based on the temperature signal output by the selecting unit, an outputting unit configured to, based on a determination result output from the determining unit, externally output a signal indicating the discharge state of the nozzle corresponding to the temperature sensor selected by the selecting unit, and a masking unit configured to, in accordance with a change in selection of the temperature sensor by the selecting unit, mask the determination result output from the determining unit to the outputting unit during a predetermined time from a timing of the change.

According to another aspect of the present invention, there is provided an image forming apparatus that includes at least one printhead with a print element substrate, wherein the print element substrate includes a plurality of heaters and a plurality of temperature sensors provided in correspondence with a plurality of nozzles, a selecting unit configured to select one temperature sensor from the plurality of temperature sensors and output a temperature signal, a determining unit configured to determine a discharge state of the nozzle based on the temperature signal output by the selecting unit, an outputting unit configured to, based on a determination result output from the determining unit, externally output a signal indicating the discharge state of the nozzle corresponding to the temperature sensor selected by the selecting unit, and a masking unit configured to, in accordance with a change in selection of the temperature sensor by the selecting unit, mask the determination result output from the determining unit to the outputting unit during a predetermined time from a timing of the change.

According to the present invention, it is possible to avoid a result of erroneously recognizing, as a feature point, a step portion generated in the temperature drop direction when the temperature sensor is changed and to check the temperature drop stage of the temperature signal accurately without being influenced by the step portion.

Further features of the present invention will become apparent from the following description of exemplary embodiments (with reference to the attached drawings).

DESCRIPTION OF THE EMBODIMENTS

First Embodiment

An embodiment of the present invention will be described below with reference to the accompanying drawings.

In this specification, the term "printing" (to be also referred to as "print" hereinafter) not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

In addition, the term "printing medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "printing (print)" described above. That is, "ink" includes a liquid which, when provided onto a printing medium, can form images, figures, patterns, and the like, can process the printing medium, or can process ink (for example, solidify or insolubilize a coloring agent contained in ink provided to the printing medium).

Further, a "printing element" generically means an orifice or a liquid channel communicating with it, and an element for generating energy used to discharge ink, unless otherwise specified.

Further, a "nozzle" generically means an orifice or a liquid channel communicating with it, and an element for generating energy used to discharge ink, unless otherwise specified.

A printhead element substrate (head substrate) used below means not merely a base made of a silicon semiconductor, but an arrangement in which elements, wiring lines, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

The printhead according to the present invention is used for not only a serial type printing apparatus to be described later but also a printing apparatus including a full-line printhead whose printing width corresponds to the width of a printing medium. Furthermore, the printhead is used for a large format printer using a printing medium of a large size such as A0 or B0 size among serial type printing apparatuses.

[Apparatus Arrangement]

Figure 6A:
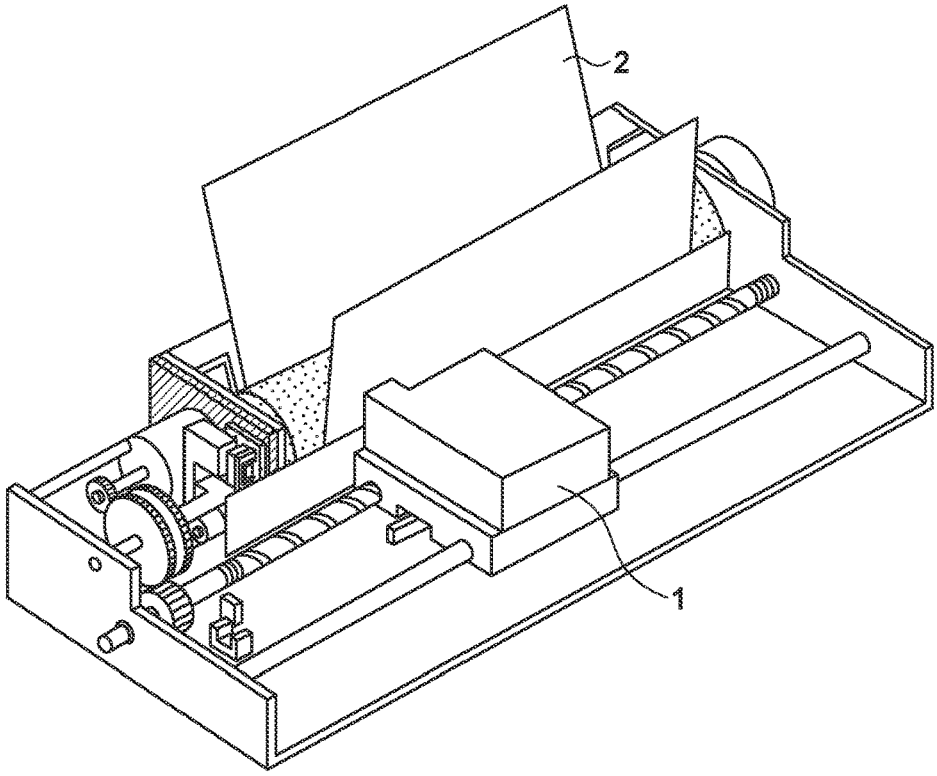
FIGS. 6A and 6B are schematic views each showing an example of the arrangement of the main part of a serial type inkjet printing apparatus.
Figure 6B:
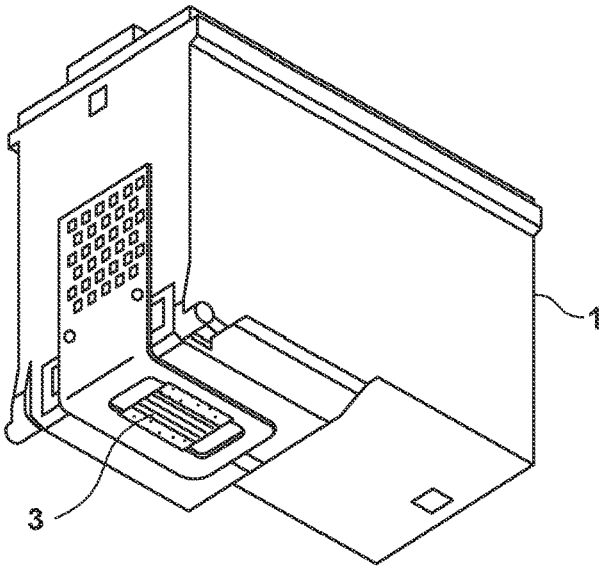

FIGS. 6A and 6B are schematic views each showing the arrangement of the main part of the serial type inkjet printing apparatus (to be simply referred to as a printing apparatus hereinafter) to which the present invention is applicable. FIG. 6A is an overall view showing the overall arrangement of the printing apparatus. An example of a serial type printhead is shown here. FIG. 6B is a perspective view showing a printhead 1 as a constituent element of the printing apparatus.

The printhead 1 prints an image on a printing medium 2 by discharging ink droplets from orifices corresponding to nozzles. The printhead 1 includes a print element substrate 3 including a plurality of nozzle arrays where a plurality of nozzles are arrayed.

Figure 7A:
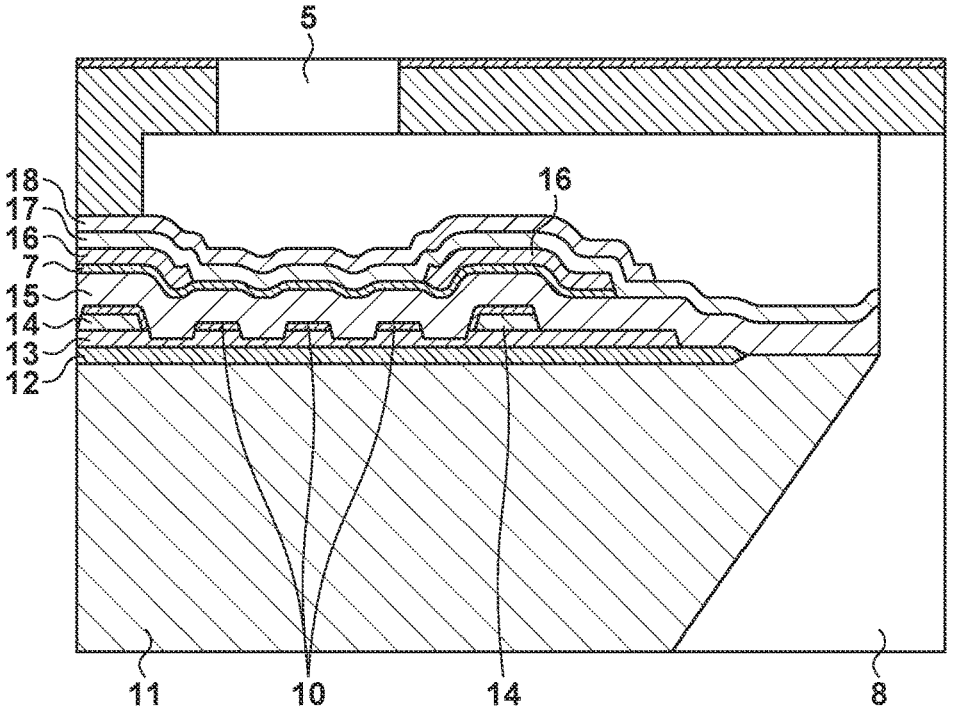
FIGS. 7A and 7B are a partial sectional view and plan view each schematically showing the enlarged peripheral portion of a heater in the print element substrate.
Figure 7B:
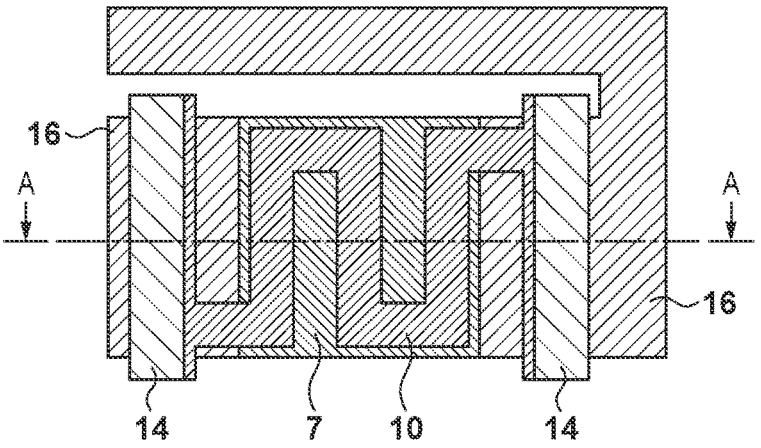

FIGS. 7A and 7B are views each schematically showing the enlarged peripheral portion of a heater 7 in the print element substrate 3. FIG. 7A is a sectional view showing the enlarged peripheral portion of the heater 7. FIG. 7B is a plan view showing the enlarged peripheral portion of the heater 7 in a direction from the side of a temperature sensor 10 to the heater 7.

In FIG. 7A, a heat accumulation layer made of a thermal oxide film 12 ($SiO_2$) and a BPSG film 13 (a silicon oxide film obtained by doping boron and phosphorus) is formed on an Si substrate 11. The temperature sensors 10, individual wiring lines 14 made of Al or the like each serving as the wiring line of a corresponding one of the temperature sensors 10, Al wiring lines 16 that connect the heater 7 and its driving control circuit (not shown), and the like are formed on this heat accumulation layer on the Si substrate 11. Each temperature sensor 10 is formed from a thin-film resistor whose resistance value changes depending on a temperature. The heater 7, a passivation film 17 made of SiN or the like, and an anti-cavitation film 18 are further stacked and formed on an interlayer insulation film 15 on the Si substrate 11. The passivation film 17 is a film for protecting a semiconductor circuit layer from ink and is formed, for example, on an entire surface by P—SiN. The anti-cavitation film 18 is a film for increasing a resistance to a cavitation formed on the heater 7 and is formed, for example, only on the periphery of the heater 7 by Ta. Each temperature sensor 10 is independently arranged immediately under a corresponding one of the heaters 7. Each individual wiring line 14 connected to the corresponding one of the temperature sensors 10 is formed as a part of a detection circuit configured to detect temperature information.

An orifice 5 is provided immediately above the heater 7. Ink discharged from the orifice 5 is supplied via a supply port 8.

In FIG. 7B, the planar shape of the temperature sensor 10 has a serpentine shape whose resistance value becomes high in a region overlapping the heater 7 in order to output a high voltage value even from a small temperature variation. With a material high in TCR (Temperature Coefficient Resistance), however, the shape of the temperature sensor 10 may be, for example, a rectangle smaller than the heater 7.

Figure 8:
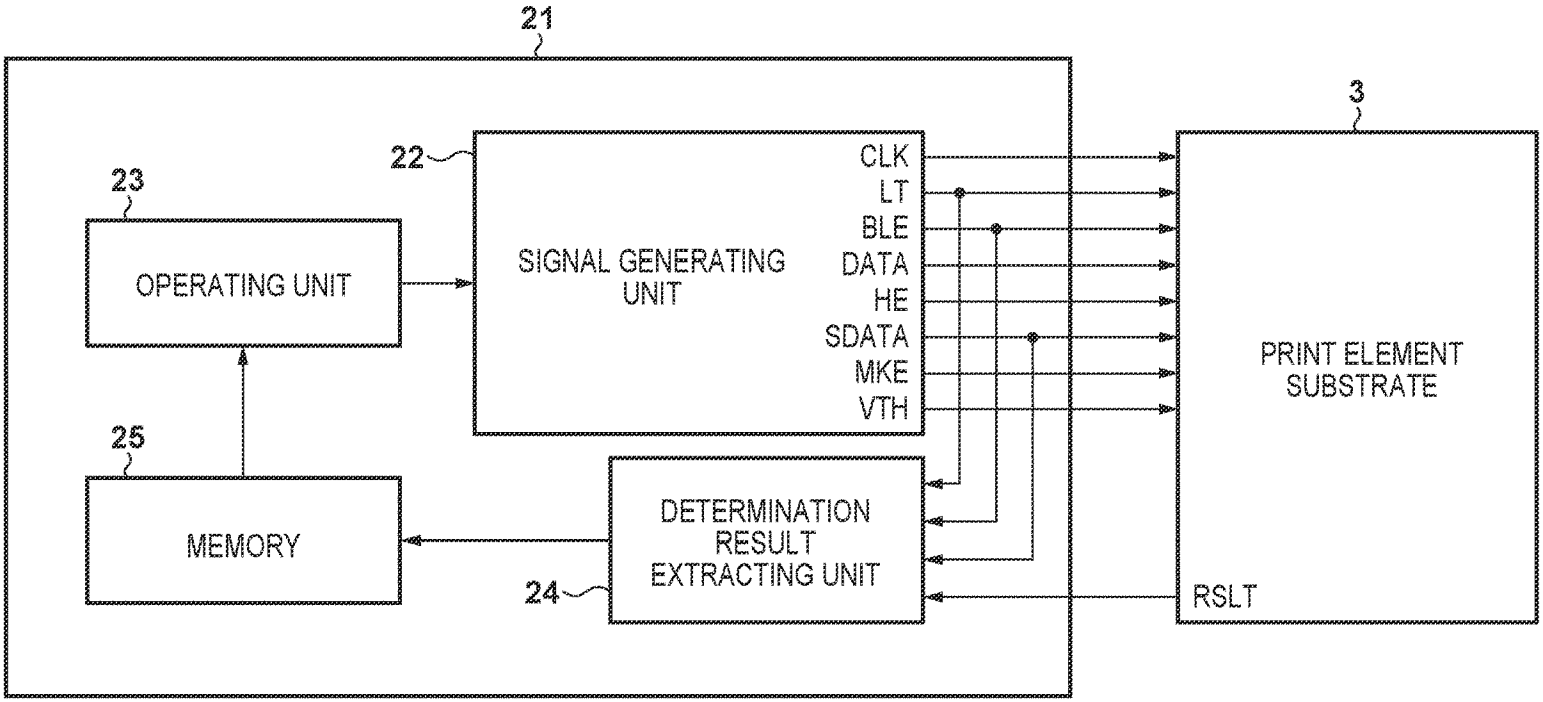
FIG. 8 is a block diagram representing an example of the control arrangement of an examination apparatus.

FIG. 8 is a block diagram representing an example of the control arrangement of an examination apparatus 21. The examination apparatus 21 includes a signal generating unit 22, an operating unit 23, a determination result extracting unit 24, and a memory 25. For example, a controlling unit that includes a CPU or the like on the main body side of the image forming apparatus corresponds to the examination apparatus 21. Upon receiving an instruction from the operating unit 23, the signal generating unit 22 outputs various input signals to the print element substrate 3. The signal generating unit 22 outputs a clock signal (CLK), a latch signal (LT), a block signal (BLE) serving as 2-bit serial data, a heater selection signal (DATA), and a heat enable signal (HE) as input signals to the print element substrate 3 here. The signal generating unit 22 further outputs, as input signals to the print element substrate 3, a sensor selection signal (SDATA), masking end signal (MKE), and threshold signal (VTH) serving as 8-bit serial data related to selection of the temperature sensors and processing of output signals.

On the other hand, the determination result extracting unit 24 receives a determination result signal (RSLT) output from the print element substrate 3 based on the temperature information detected by the temperature sensors 10 and extracts a determination result for each block in synchronism with the latch signal (LT). Then, if the determination result is nondischarge, the determination result extracting unit 24 records the block signal (BLE) and the sensor selection signal (SDATA) in the memory 25. That is, the determination result extracting unit 24 sets the determination result signal (RSLT) from the print element substrate 3 and the latch signal (LT), block signal (BLE), and sensor selection signal (SDATA) from the signal generating unit 22 as the input signals.

Upon receiving the block signal (BLE) and sensor selection signal (SDATA) of a nondischarge nozzle recorded in the memory 25, the operating unit 23 eliminates a signal corresponding to the nondischarge nozzle from the heater selection signal (DATA) of a corresponding block if a heater to be driven includes the nondischarge nozzle. Then, the operating unit 23 adds a signal corresponding to a nozzle for complementing nondischarge to the heater selection signal (DATA) of the corresponding block instead and outputs it to the signal generating unit 22.

Figure 1:
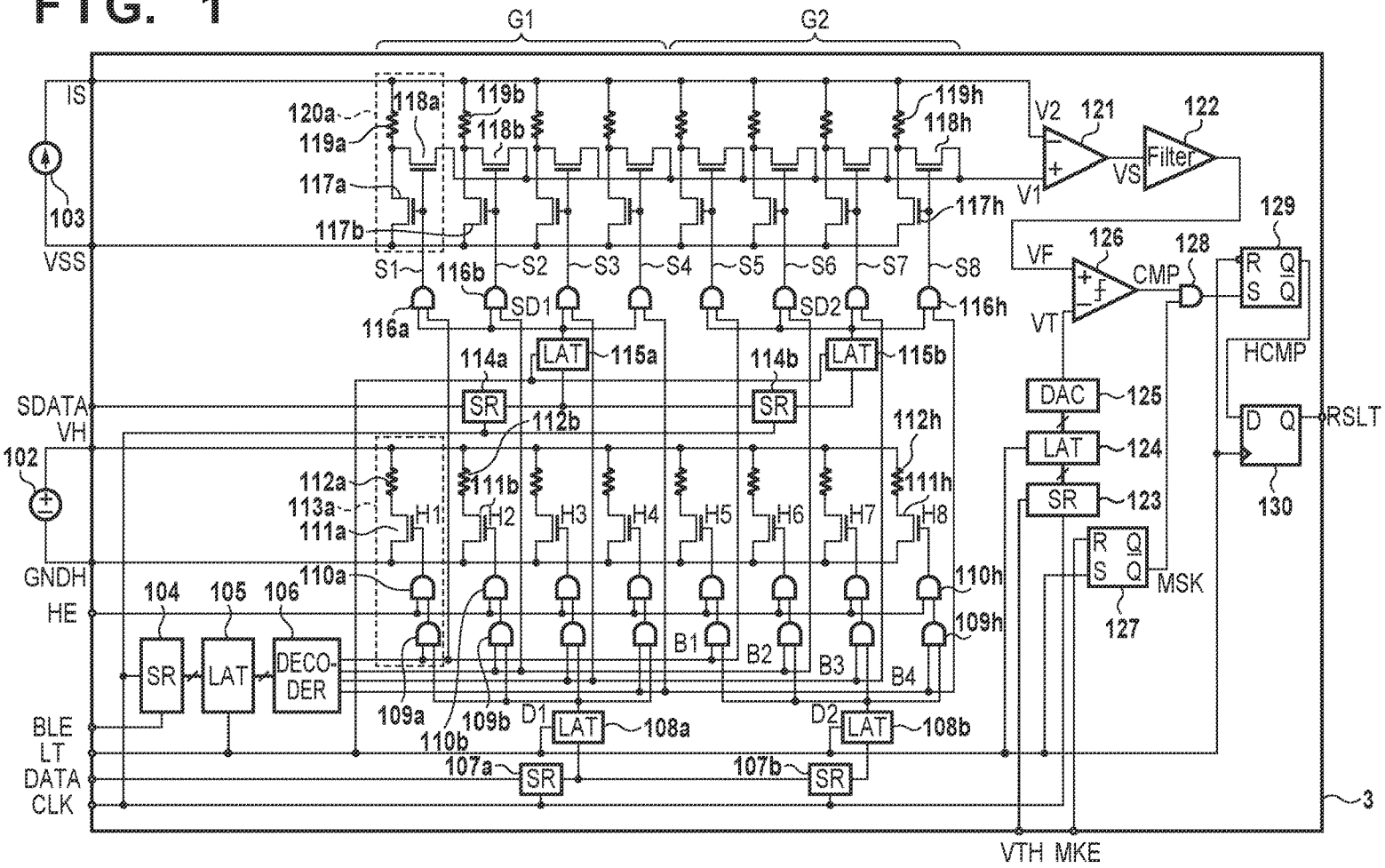
FIG. 1 is a block diagram showing an example of the circuit arrangements on a print element substrate according to the first embodiment.

FIG. 1 is a block diagram showing an example of the arrangements of driving circuits of heaters and processing circuits of output signals of temperature sensors mounted on the print element substrate 3 according to this embodiment. For the sake of descriptive simplicity here, the print element substrate 3 includes eight heaters 112*a* to 112*h* and temperature sensors 119*a* to 119*h*, respectively, and arrays them in an order as shown in FIG. 1.

The print element substrate 3 includes a constant voltage source 102 configured to drive the heaters 112*a* to 112*h*, a constant current source 103 for the temperature sensors 119*a* to 119*h*, and an input/output unit (a pad or a terminal) that inputs/outputs a signal or information to/from the outside.

A switch element (MOS transistor) 111*a* forms one driving circuit 113*a* together with the heater 112*a* and gate circuits 109*a* and 110*a*, and controls application of the voltage of the constant voltage source 102 to the heater 112*a*.

A switch element 117*a* forms one temperature obtaining circuit 120*a* together with a switch element 118*a* and the temperature sensor 119*a*, and controls application of the current of the constant current source 103 to the temperature sensor 119*a*. The switch element 118*a* controls the output of a voltage generated in the temperature sensor 119*a* to a differential amplifier 121. The temperature sensor 119*a* measures a temperature corresponding to the heater 112*a*.

Switch elements control other seven heaters and temperature sensors in the same manner. Therefore, the circuit arrangement of FIG. 1 includes eight driving circuits, namely, the driving circuit 113*a* and driving circuits 113*b* to 113*h* and eight temperature obtaining circuits, namely, the temperature obtaining circuit 120*a* and temperature obtaining circuits 120*b* to 120*h*. Each of the eight driving circuits 113*a* to 113*h* and the eight temperature obtaining circuits 120*a* to 120*h* are divided into two groups G1 and G2. Each group is made of four driving circuits and four temperature obtaining circuits.

[Logic Circuit]

Figure 2:
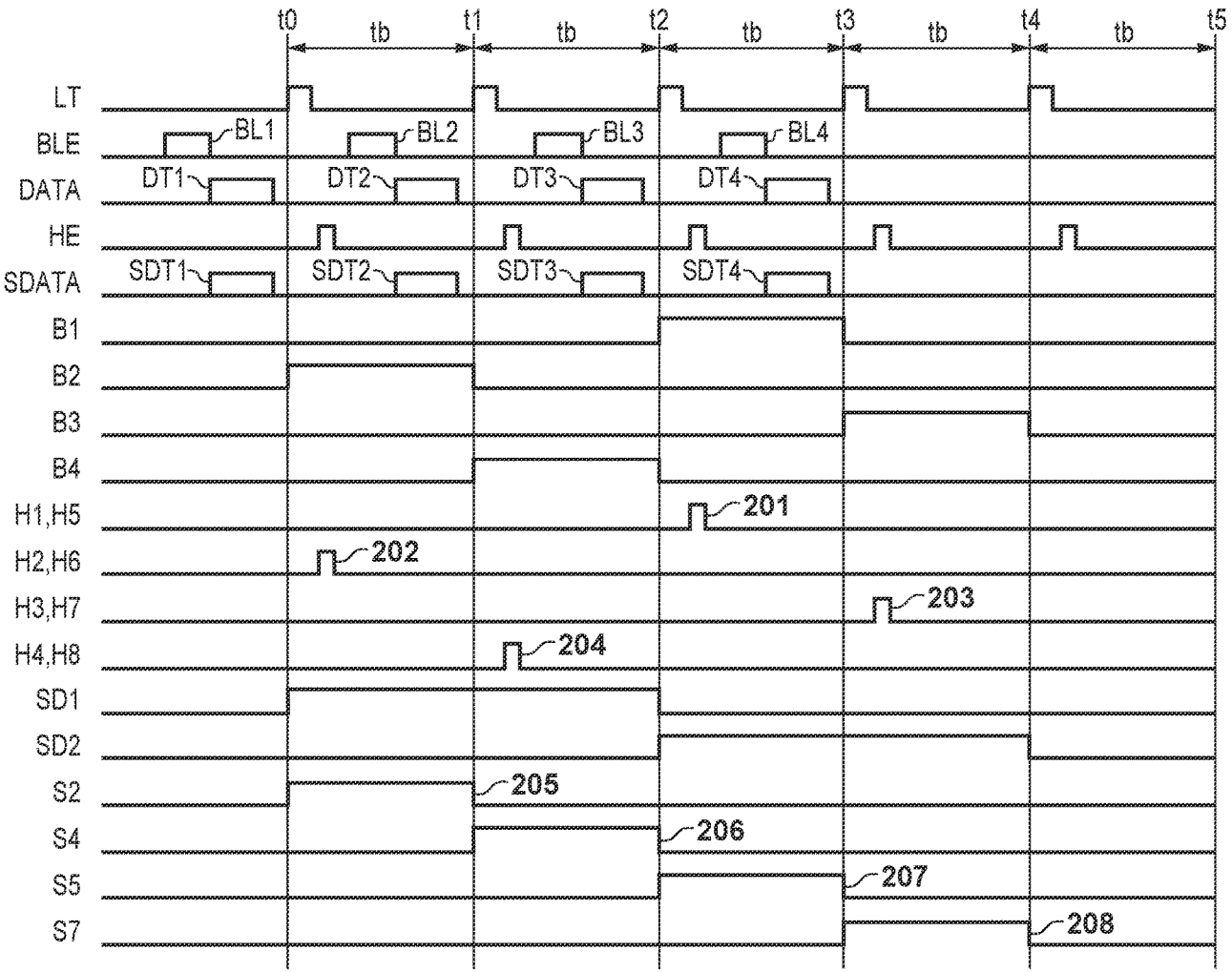
FIG. 2 is a timing chart in a logic circuit unit according to the first embodiment.

FIG. 2 is a timing chart representing control timings in a logic circuit unit of the print element substrate 3. The operation of the logic circuit unit of the print element substrate 3 according to this embodiment will be described below based on FIGS. 1 and 2.

The print element substrate 3 receives the clock signal (CLK), latch signal (LT), block signal (BLE) serving as the 2-bit serial data, heater selection signal (DATA) serving as 2-bit serial data, and heat enable signal (HE) transferred from the examination apparatus 21. The print element substrate 3 further receives the sensor selection signal (SDATA) serving as 2-bit serial data. Except for the clock signal (CLK), the print element substrate 3 receives the signals at the intervals of block periods tb. That is, the control of the eight driving circuits 113*a* to 113*h* and eight temperature obtaining circuits 120*a* to 120*h* is performed time-divisionally in four blocks.

Block signals BL1 to BL4 are transferred to a shift register 104 in synchronism with the clock signal (CLK) and latched by a latch circuit 105 based on the latch signal (LT) at timings t0 to t3, respectively. Furthermore, the block signals BL1 to BL4 latched in the latch circuit 105 are decoded by a decoder 106 and output to wiring lines B1 to B4. Signals of the wiring lines B1 to B4 are held during the block period tb until a next latch timing, and a next block signal is transferred to the shift register 104 during that period.

Only one signal out of four signals of the wiring lines B1 to B4 becomes valid and is used to select heaters to be driven simultaneously. In FIG. 1, the wiring line B1 is connected to the gate circuit 109*a* and a gate circuit 109*e*. Therefore, the heaters 112*a* and 112*e* can be driven simultaneously if the signal of the wiring line B1 becomes valid (High active). Likewise, the heaters 112*b* and 112*f* can be driven simultaneously if the signals of the wiring lines B2 to B4 become valid, the heaters 112*c* and 112*g* can be driven simultaneously if the signal of the wiring line B3 becomes valid, and the heaters 112*d* and 112*h* can be driven simultaneously if the signal of the wiring line B4 becomes valid.

As shown in FIG. 2, in this embodiment, a case will be handled in which driving that validates B2, B4, B1, and B3, respectively, between the timings t0 and t1, between the timings t1 and t2, between the timings t2 and t3, and between the timing t3 and a timing t4 so as not to drive adjacent heaters continuously is performed time-divisionally.

Heater selection signals DT1 to DT4 are transferred to shift registers 107*a* and 107*b* in synchronism with the clock signal (CLK) and latched by latch circuits 108*a* and 108*b* based on the latch signal (LT) at the timings t0 to t3, respectively. Furthermore, the heater selection signals DT1 to DT4 latched by the latch circuits 108*a* and 108*b* are output to wiring lines D1 and D2. Signals of the wiring lines D1 and D2 are held during the block period tb until a next latch timing, and a next heater selection signal is transferred to the shift registers 107*a* and 107*b* during that period.

Signals of the wiring lines D1 and D2 are used to select the groups G1 and G2 of the heaters. In FIG. 1, the wiring line D1 is connected to the gate circuit 109*a* and gate circuits 109*b* to 109*d*. Therefore, the heaters 112*a* and 112*d* of the group G1 can be selected if the signal of the wiring line D1 becomes valid (High active). Likewise, the heaters 112*e* to 112*h* of the group G2 can be selected if the signal of the wiring line D2 becomes valid.

In this embodiment, a case will be handled in which the heaters of all groups are selected (both D1 and D2 are valid)

in the four continuous block periods tb (t0 to t4). That is, driving of all the eight heaters is completed in a period from t0 to t4.

The signals of the wiring lines B1 to B4 are, respectively, input to the gate circuits 109*a* to 109*d* together with the signal of the wiring line D1. Output signals of the gate circuits 109*a* to 109*d* are, respectively, further input to the gate circuit 110*a* and gate circuits 110*b* to 110*d* together with the heat enable signal (HE). The gate circuits 110*a* to 110*d* output pulse signals 201 to 204 to wiring lines H1 to H4, respectively. The wiring lines H1 to H4 are connected to the switch elements 111*a* to 111*d*, respectively. The pulse signals 201 to 204 drive the heaters 112*a* to 112*d*, respectively.

Likewise, gate circuits 110*e* to 110*h* also output the pulse signals 201 to 204 to wiring lines H5 to H8, respectively. The wiring lines H5 to H8 are connected to switch elements 111*e* to 111*h*, respectively. The pulse signals 201 to 204 drive the heaters 112*e* to 112*h*, respectively.

Sensor selection signals SDT1 to SDT4 are transferred to shift registers 114*a* and 114*b* in synchronism with the clock signal (CLK) and latched by latch circuits 115*a* and 115*b* based on the latch signal (LT) at the timings t0 to t3, respectively. Furthermore, the sensor selection signals SDT1 to SDT4 latched by the latch circuits 115*a* and 115*b* are output to wiring lines SD1 and SD2. Signals of the wiring lines SD1 and SD2 are held during the block period tb until a next latch timing, and a next sensor selection signal is transferred to the shift registers 114*a* and 114*b* during that period.

The signals of the wiring lines SD1 and SD2 validate only one signal out of the heater selection signals to be valid, and are used to select one group from G1 and G2 that includes the temperature sensor corresponding to a heater to be driven. In FIG. 1, the wiring line SD1 is connected to gate circuits 116*a* to 116*d*. Therefore, the temperature sensors 119*a* to 119*d* of the group G1 can be selected if the signal of the wiring line SD1 becomes valid (High active). Likewise, the temperature sensors 119*e* to 119*h* of the group G2 can be selected if the signal of the wiring line SD2 becomes valid.

As shown in FIG. 2, in this embodiment, a case will be handled in which the signal of the wiring line SD1 is validated to select the temperature sensors of the group G1 between t0 and t1, and between t1 and t2 out of the four continuous block periods tb. A case will also be handled in which the signal of the wiring line SD2 is validated to select the temperature sensors of the group G2 between t2 and t3, and between t3 and t4.

The signals of the wiring lines B1 to B4 are used as block signals for selecting the temperature sensors. That is, the signals of the wiring lines B1 to B4 are, respectively, input to the gate circuits 116*a* to 116*d* together with the signal of the wiring line SD1. Likewise, the signals of the wiring lines B1 to B4 are, respectively, input to gate circuits 116*e* to 116*h* together with the signal of the wiring line SD2.

With the above, between t0 to t1, the gate circuit 116*b* outputs a pulse signal 205 to a wiring line S2. The wiring line S2 is connected to switch elements 117*b* and 118*b*. The pulse signal 205 applies a constant current to the temperature sensor 119*b* between t0 and t1, and a voltage generated in the temperature sensor 119*b* is output to the differential amplifier 121.

Between t1 to t2, the gate circuit 116*d* outputs a pulse signal 206 to a wiring line S4. The wiring line S4 is connected to switch elements 117*d* and 118*d*. The pulse signal 206 applies a constant current to the temperature sensor 119*d* between t1 and t2, and a voltage generated in the temperature sensor 119*d* is output to the differential amplifier 121.

Between t2 to t3, the gate circuit 116*e* outputs a pulse signal 207 to a wiring line S5. The wiring line S5 is connected to switch elements 117*e* and 118*e*. The pulse signal 207 applies a constant current to the temperature sensor 119*e* between t2 and t3, and a voltage generated in the temperature sensor 119*e* is output to the differential amplifier 121.

Between t3 to t4, the gate circuit 116*g* outputs a pulse signal 208 to a wiring line S7. The wiring line S7 is connected to switch elements 117*g* and 118*g*. The pulse signal 208 applies a constant current to the temperature sensor 119*g* between t3 and t4, and a voltage generated in the temperature sensor 119*g* is output to the differential amplifier 121.

[Analog Signal Processing]

Figure 3:
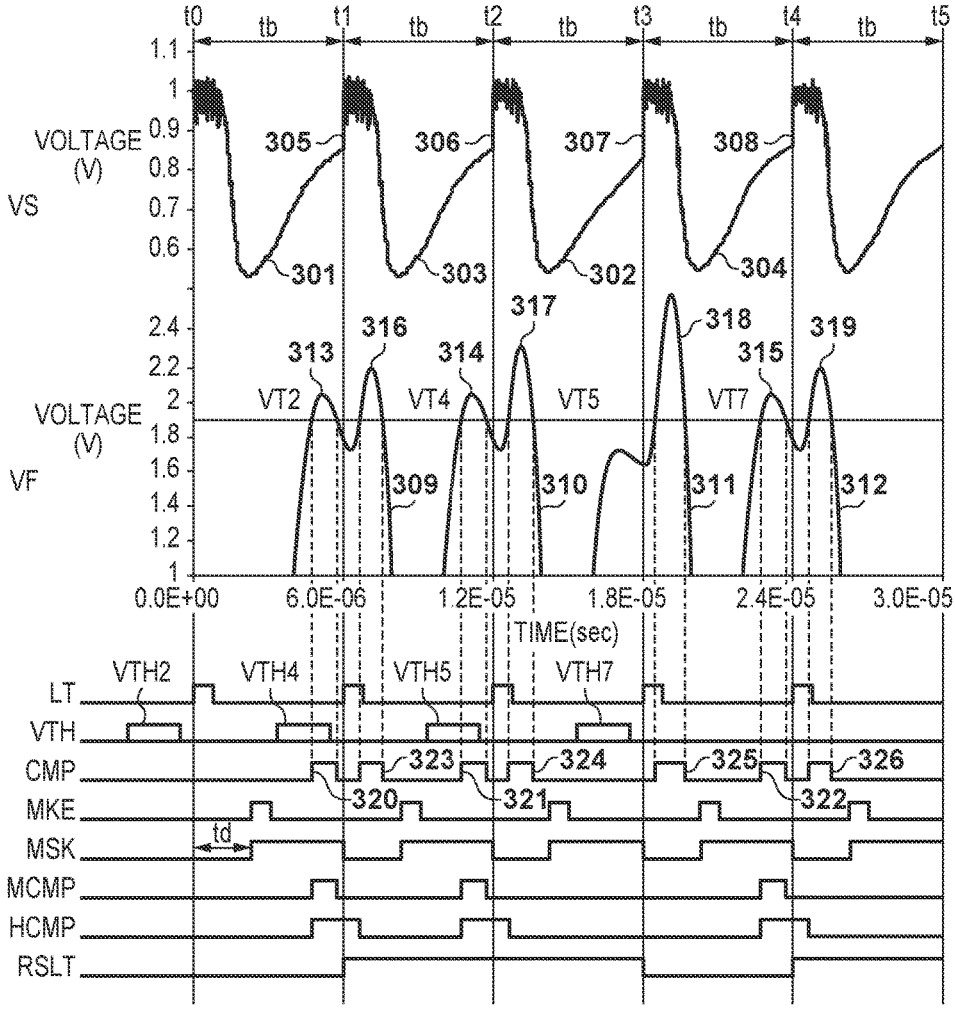
FIG. 3 is a timing chart in an analog signal processing unit according to the first embodiment.

FIG. 3 is a timing chart representing control timings in an analog signal processing unit and determination circuit unit of the print element substrate. The operations of the analog signal processing unit and determination circuit unit of the print element substrate according to this embodiment will be described below based on FIGS. 1 and 3.

The differential amplifier 121 continuously (301, 302, 303, and 304) outputs a signal VS (temperature information) obtained by subtracting a voltage V2 on the side of an IS terminal from a voltage V1 on the side of a VSS terminal of each of the selected temperature sensors 119*b*, 119*d*, 119*e*, and 119*g*. The signal VS output from the differential amplifier 121 is input to a filter circuit 122. The signal VS as the output of the differential amplifier 121 is shown in the upper row of FIG. 3.

Figure 4A:
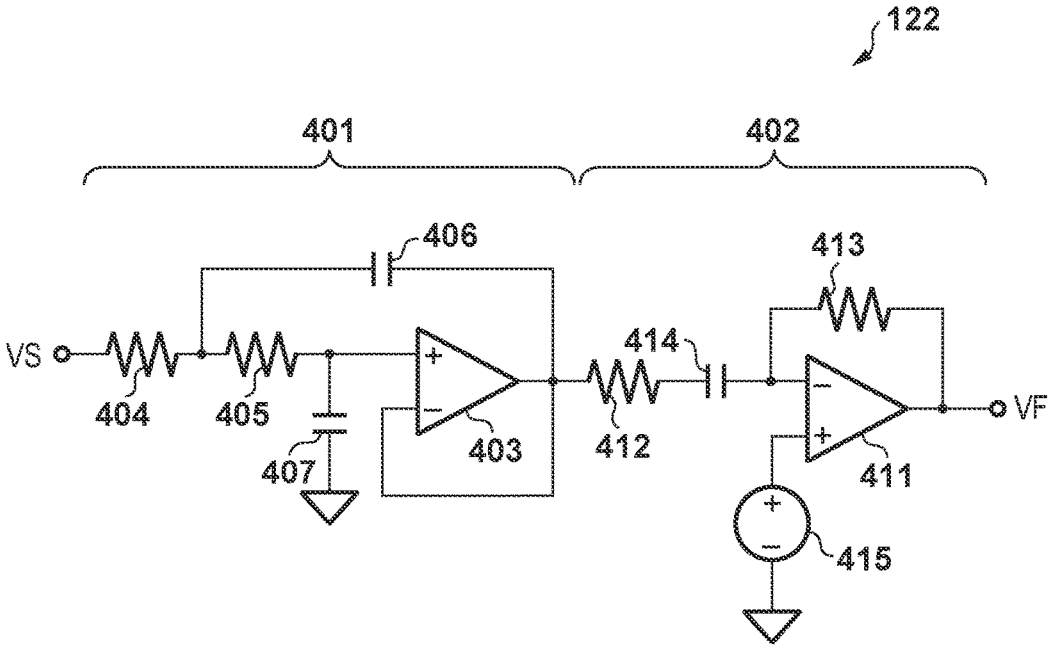
FIGS. 4A and 4B are circuit diagrams each showing an example of the arrangement of a filter circuit according to the first embodiment.

As shown in FIG. 4A, the filter circuit 122 is formed by a bandpass filter that cascade-connects a second-order low-pass filter 401 and a first-order high-pass filter 402.

The low-pass filter 401 is formed from an operational amplifier 403, resistors R1L 404 and R2L 405, and capacitors C1L 406 and C2L 407. The low-pass filter 401 has a predetermined passband and attenuates high-frequency noise on a higher-frequency band side than a cutoff frequency fcL. The cutoff frequency fcL here is obtained by:

$$fcL=1/[2\pi\cdot\sqrt{(R1L\cdot R2L\cdot C1L\cdot C2L)}] \quad (1)$$

The high-pass filter 402 is formed from an operational amplifier 411, resistors R1H 412 and R2H 413, a capacitor CH 414, and a constant voltage source 415. The high-pass filter 402 has a predetermined passband, extracts a temperature drop speed by performing the first order derivative of a lower-frequency band side than a cutoff frequency fcH, and removes a DC component. The cutoff frequency fcH here is obtained by:

$$fcH=1/(2\pi\cdot R1H\cdot CH) \quad (2)$$

With signal processing by the filter circuit 122 described above, the filter circuit 122 outputs a signal VF to be the basis of determining whether normal discharge or abnormal discharge is obtained. The signal VF as the output of the filter circuit 122 is shown in the middle row of FIG. 3.

Note that the signal VF may become a negative voltage equal to or lower than a ground potential GND if the positive terminal of the operational amplifier 411 is grounded directly. At this time, VF=0 V is obtained actually and fed back to the negative terminal of the operational amplifier 411, ending up in outputting the unexpected signal VF. In order to avoid this, in this embodiment, the constant voltage source 415 applies an offset voltage sufficient for the signal VF to become equal to or higher than the ground potential GND to the positive terminal.

Figure 4B:
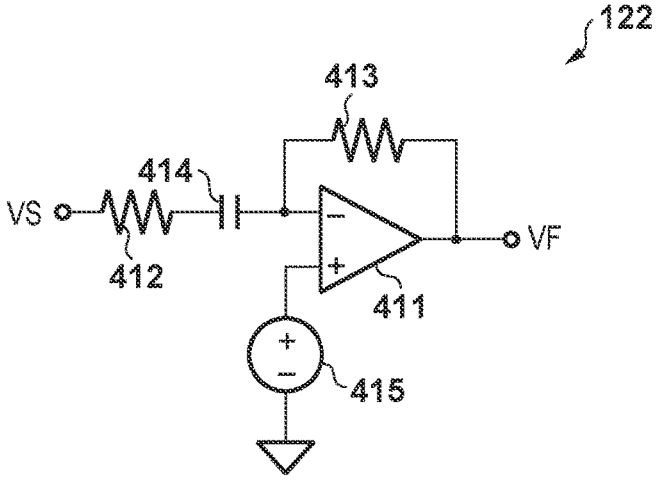

If the low-pass filter 401 cannot attenuate high-frequency noise included in the signal VS sufficiently, the two low-pass filters 401 may be cascade-connected. In contrast, if the high-frequency noise included in the signal VS is at a level where it can pass through the high-pass filter 402 directly without any problem, the filter circuit 122 may be formed from only the high-pass filter 402 by omitting the low-pass filter 401 as shown in FIG. 4B.

The print element substrate 3 receives the masking end signal (MKE) and threshold signal (VTH) serving as the 8-bit serial data transferred from the examination apparatus 21 at the intervals of the block periods tb. The masking end signal (MKE) is a signal obtained by delaying the latch signal (LT) by a predetermined delay amount td.

Threshold signals VTH2, VTH4, VTH5, and VTH7 input to the print element substrate 3 are transferred to a shift register 123 in synchronism with the clock signal (CLK). Then, the threshold signals VTH2, VTH4, VTH5, and VTH7 are latched by a latch circuit 124 based on the latch signal (LT) at the timings t0 to t3, respectively and output to a digital-to-analog converter (DAC) 125. Output signals of the latch circuit 124 are held during the block period tb until a next latch timing, and a next threshold signal is transferred to the shift register 123 during that period.

Each output signal of the digital-to-analog converter (DAC) 125 is input to the negative terminal of a comparator 126 as a threshold voltage VT. On the other hand, the output signal VF of the filter circuit 122 is input to the positive terminal of the comparator 126. The comparator 126 compares the signal VF with the threshold voltage VT and outputs a signal (CMP) to be valid (normal discharge) if VF>VT.

In FIG. 3, peaks 313, 314, and 315 exceeding the threshold voltage VT derived from normal discharge occur in signals 309, 310, and 312, respectively, and determination pulse signals 320, 321, and 322 owing to these are produced in the signal (CMP). On the other hand, a signal 311 is based on the temperature signal 302 of abnormal discharge, generating no peak derived from normal discharge nor producing the determination pulse signals in the signal (CMP).

Moreover, however, peaks 316 to 319 exceeding the threshold voltage VT derived from steps 305 to 308 between the temperature signals occur in signals 309 to 312, respectively, and undesired determination pulse signals 323 to 326 owing to these are produced in the signal (CMP). That is, the peaks 316 to 319 are caused by discontinuous changes such as the steps 305 to 308 of the temperature signals at a timing when the temperature sensor changes. This undesired determination pulse signal is also produced between t2 and t3 when the threshold signal VTHS is set, and the discharge state of the temperature signal 302 of abnormal discharge is determined (a pulse signal 324), leading to a result of erroneously determining that a nozzle of abnormal discharge is of normal discharge.

To cope with this, a masking signal (MSK) that masks a section where the undesired determination pulse signals 323 to 326 of pulsed signals each causing an erroneous determination are produced is generated by a procedure to be described below. Then, the masking signal (MSK) is used to remove the undesired determination pulse signals 323 to 326 from the signal (CMP).

The undesired determination pulse signals 323 to 326 are produced between the rising edge of the latch signal (LT) as a timing to change temperature sensors 119 when the steps 305 to 308 between the temperature signals occur and the delay amount td that includes a delay time caused by the time constant of the filter circuit 122. On the other hand, the peaks 313, 314, and 315 occur after the elapse of the delay amount td, as shown in FIG. 3.

Therefore, the masking signal (MSK) to be Low in the above-described section is output from the inverted output terminal of the RS latch circuit 127 by inputting the latch signal (LT) to the set input terminal of an RS latch circuit 127 and inputting the masking end signal (MKE) as a predetermined time to the reset input terminal. Furthermore, a signal (MCMP) obtained by removing the undesired determination pulse signals 323 to 326 is obtained as the output of a gate circuit 128 by inputting the signal (CMP) and the masking signal (MSK) to the gate circuit 128.

A determination pulse signal (HCMP) is held by inputting the signal (MCMP) to the set input terminal of an RS latch circuit 129. This signal (HCMP) is latched by a flip-flop circuit 130 using the latch signal (LT) as a trigger, obtaining the determination result signal (RSLT) to be valid (High) in a next block period at the time of normal discharge.

The signal (HCMP) that holds the determination pulse signal is reset at the trailing edge of the latch signal (LT) by inputting an inverted signal of the latch signal (LT) to the reset input terminal of the RS latch circuit 129.

In synchronism with the trailing edge of the latch signal (LT), the determination result signal (RSLT) is extracted by the determination result extracting unit 24 shown in FIG. 8 together with the block signal (BLE) and sensor selection signal (SDATA) delayed by the block period.

As described above, in this embodiment, the undesired determination pulse signals 323 to 326 produced in the signal (CMP) are masked by the masking signal (MSK) and removed. With this arrangement, it is possible to adopt an arrangement with a logic circuit which is simpler than an analog circuit of a mechanism for not generating the peaks 316 to 319 themselves exceeding the threshold voltage VT, and to implement the determination of the discharge state of an inexpensive and highly reliable nozzle.

Second Embodiment

Figure 5:
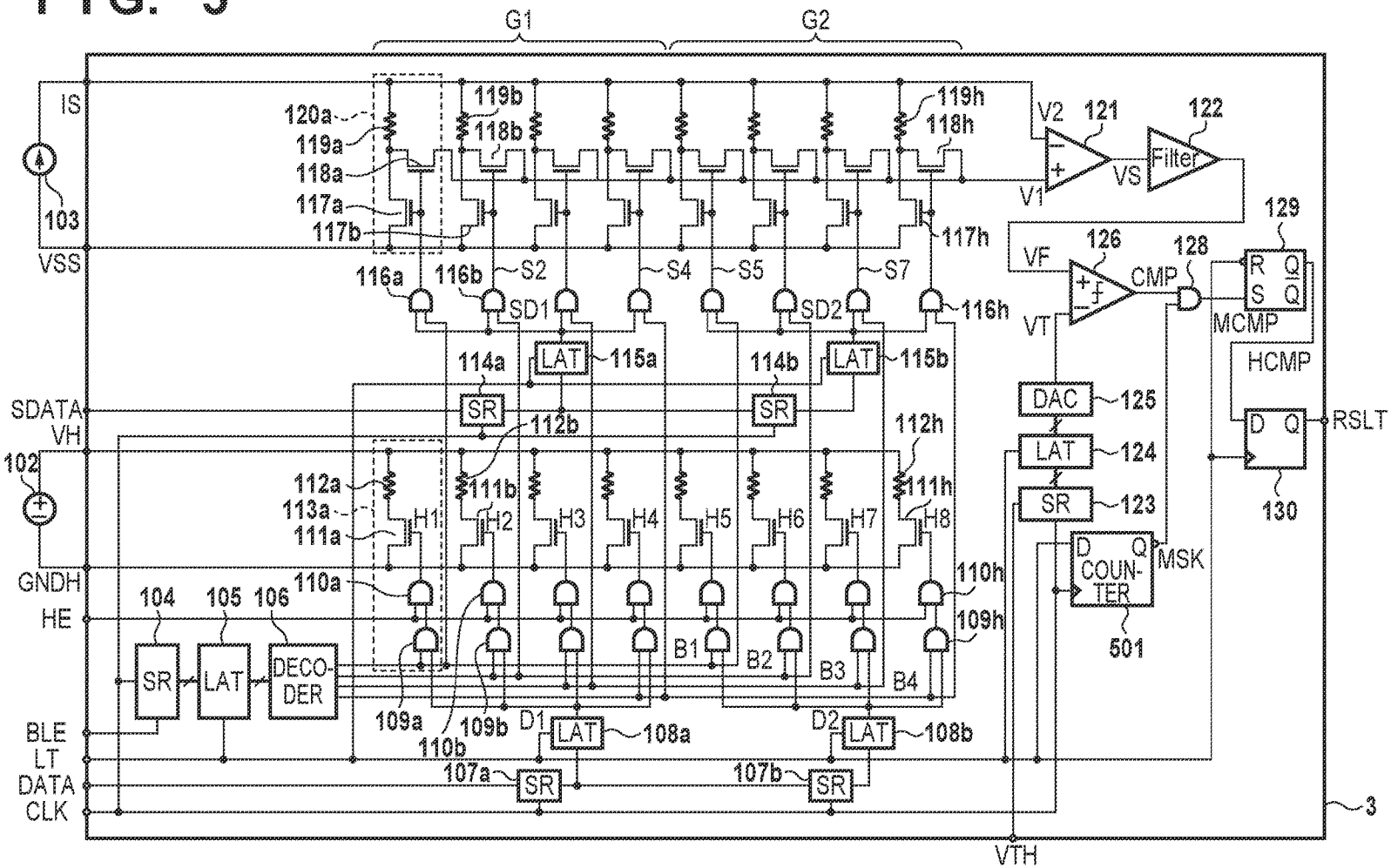
FIG. 5 is a block diagram showing an example of the circuit arrangements on a print element substrate according to the second embodiment.

FIG. 5 is a block diagram showing an example of the arrangements of driving circuits of heaters and processing circuits of output signals of temperature sensors mounted on a print element substrate 3 according to the second embodiment of the present invention. In FIG. 5, a logic circuit unit and a determination circuit unit except for a masking signal generating unit formed from a counter circuit are the same as in the first embodiment, and thus a description thereof will be omitted.

The operation of the masking signal generating unit of the print element substrate according to this embodiment will be described below based on FIG. 5. This embodiment includes a counter circuit 501 in place of the RS latch circuit 127 of FIG. 1 described in the first embodiment.

The counter circuit 501 is a down counter that subtracts the pulse of a clock signal (CLK) while counting. The initial value of the counter circuit 501 is set, and its output signal rises (High) at the rising edge of a latch signal (LT). The initial value used here is set such that a value multiplied by a clock period becomes a delay amount td. Subsequently, the counter circuit 501 starts counting the pulse of the clock signal (CLK), and its output signal falls (Low) at a timing when the pulse becomes 0 as a result of counting a predetermined number of times.

It becomes possible to mask an undesired determination pulse signal as in the first embodiment by using an inverted signal of the output signal as a masking signal (MSK).

As described above, the masking signal generating unit according to this embodiment generates a masking end timing inside the print element substrate 3 based on the latch signal (LT) without receiving the supply of a masking end signal (MKE) from a signal generating unit 22 of an examination apparatus 21 as in the first embodiment. Therefore, in addition to an effect in the first embodiment, it becomes possible to reduce the signal input terminal of the print element substrate 3.

Third Embodiment

Figure 9:
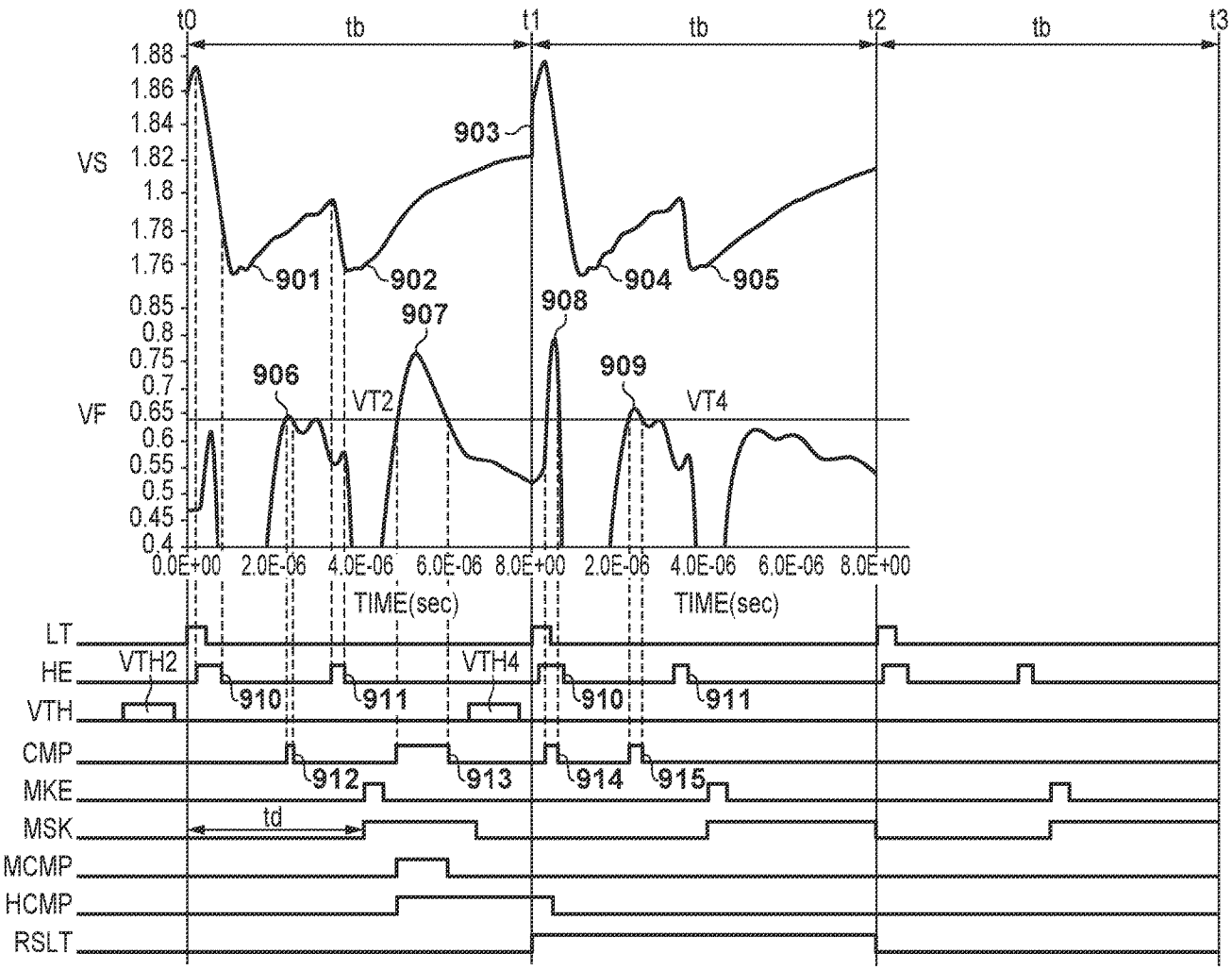
FIG. 9 is a timing chart in an analog signal processing unit according to the third embodiment.

FIG. 9 is a timing chart representing control timings in an analog signal processing unit and determination circuit unit of a print element substrate according to the third embodiment of the present invention. The circuit arrangement of the print element substrate is the same as in FIG. 1, and thus a description thereof will be omitted.

The operations of the analog signal processing unit and determination circuit unit of the print element substrate according to this embodiment will be described below based on FIGS. 1 and 9.

In the third embodiment, in order to increase a signal derived from normal discharge and to improve a determination accuracy, in a heat enable signal (HE), post pulses 911 that do not reach discharge are applied after main pulses 910 for discharging a liquid to each heater from a corresponding one of nozzles are applied. Referring to FIG. 9, a signal VS as the output of a differential amplifier 121 at this time is shown in the upper row, and a signal VF as the output of a filter circuit 122 is shown in the middle row. A curve in a graph in the upper row of FIG. 9 indicates that it falls as a temperature increases and rises as the temperature decreases. For example, in the upper row of FIG. 9, each of downward-convex peaks 901, 902, 904, and 905 indicates a peak in rise of the temperature.

In the case of normal discharge, a peak 907 exceeding a threshold voltage VT occurs in the signal VF, and a determination pulse signal 913 owing to this is produced in a signal (CMP). This is because of a rapid temperature drop which is caused by the tail of a discharged droplet dropping on a heater interface.

On the other hand, in the case of abnormal discharge, a peak exceeding the threshold voltage VT does not occur in the signal VF. Accordingly, no determination pulse signal is produced in the signal (CMP) either. This is because a temperature drops slowly due to abnormal discharge.

In the signal VS, between timings t0 and t1, the peak 907 occurs in the signal VF after the post pulse 911 is applied. This peak 907 exceeds a threshold voltage VT2 and represents normal discharge. In the case of normal discharge, this increases the value of the signal VF because the temperature drops rapidly after the peak 907.

On the other hand, between the timing t1 and a timing t2, although a peak occurs in the signal VF after the post pulse 911 is applied, it does not exceed a threshold voltage VT4 and represents abnormal discharge. In the case of abnormal discharge, this decreases the value of the signal VF because the temperature drops slowly after the peak 905. However, after the main pulse 910 is applied to each heater, between t0 and t1, in the signal VS, the downward-convex peak 901 occurs, and then the temperature drops comparatively rapidly. Consequently, a peak 906 occurs in the signal VF between t0 and t1. Likewise, a peak 909 occurs in the signal VF between t1 and t2. Occurrence of these peaks 906 and 909 produces undesired determination pulse signals 912 and 915 in the signal (CMP). Such undesired determination pulse signals 912 and 915 cause sensing errors.

To cope with this, a masking signal (MSK) that covers not only a section where an undesired determination pulse signal 914 is produced but also a section where the determination pulse signals 912 and 915 are produced is generated by the same procedure as the procedure described in the first embodiment. Then, the masking signal (MSK) is used to remove the undesired determination pulse signals 912, 914, and 915 from the signal (CMP).

Note that generation of the masking signal (MSK) is not limited to the first embodiment. For example, the masking signal (MSK) may be generated with reference to a main pulse generation timing. In addition, a timing at which the masking signal (MSK) ends may be a post pulse generation timing.

Other Embodiments

The present invention is not limited to the values and forms shown in the above-described embodiments. For example, the number of heaters and temperature sensors of a print element substrate 3 is not limited to eight and may be a value such as 64, 128, or 256. In addition, a circuit arrangement according to this embodiment may be a form in which an analog signal processing unit is provided inside a determination circuit unit or may be a form in which the determination circuit unit is provided in the analog signal processing unit.

A temperature sensor selection period is not limited to one block period tb and may be extended to a plurality of block periods. In this case, one determination is made for a plurality of blocks. It becomes possible, however, to make one determination per block if all the blocks are divided into groups of the number of blocks, and the analog signal processing unit and the determination circuit unit are provided for each group.

An examination apparatus 21 serving as a temperature measurement apparatus and the print element substrate 3 shown in FIG. 8 are shown in a one-to-one relationship. However, an arrangement with one examination apparatus 21 with respect to a plurality of print element substrates may be adopted. In addition, the examination apparatus 21 may be integrated with a control unit (such as a CPU) that performs image forming processing.

In the first embodiment, the example has been described in which the constituent elements 121 to 130 of FIG. 1 are arranged in the print element substrate 3. However, the present invention is not limited to this arrangement, and these constituent elements may be provided outside the print element substrate 3. Likewise, in the second embodiment, the example has been described in which the constituent elements 121 to 126, 128 to 130, and 501 of FIG. 5 are arranged in the print element substrate 3. These constituent elements may be provided outside the print element substrate 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-244537, filed Dec. 16, 2016, which is hereby incorporated by reference herein in its entirety.

What is claimed is:

1. A print element substrate that includes a plurality of heaters and a plurality of temperature sensors provided in correspondence with a plurality of nozzles, the substrate comprising:

a selecting unit configured to select one temperature sensor from the plurality of temperature sensors and output a temperature signal, and change the temperature sensor;

a determining unit configured to determine a discharge state of the nozzle based on the temperature signal output by the selecting unit;

an outputting unit configured to, based on a determination result output from the determining unit, externally output a signal indicating the discharge state of the nozzle corresponding to the temperature sensor selected by the selecting unit; and a masking unit configured to, in accordance with a change of the temperature sensor by the selecting unit, mask the determination result output from the determining unit to the outputting unit for a predetermined time after the change of the temperature sensor.

2. The substrate according to claim 1, wherein the predetermined time is determined based on a delay time caused by the determining unit.

3. The substrate according to claim 1, wherein the determination result output from the determining unit to the outputting unit is removed by the masking unit for the predetermined time.

4. The substrate according to claim 1, wherein in accordance with the change of the temperature sensor by the selecting unit, a pulsed signal output from the determining unit as a determination result is produced during the predetermined time due to a discontinuous change in the temperature signal at the timing of the change.

5. The substrate according to claim 1, wherein if the discharge state of the nozzle corresponding to the temperature sensor selected by the selecting unit represents normal discharge, a pulsed signal corresponding to the determination result from the determining unit is produced after an elapse of the predetermined time, and if the discharge state of the nozzle corresponding to the temperature sensor selected by the selecting unit is abnormal, the pulsed signal is not produced after the elapse of the predetermined time.

6. The substrate according to claim 1, wherein a timing at which the predetermined time ends is externally provided for the masking unit.

7. The substrate according to claim 1, wherein a timing at which the predetermined time ends is generated by counting a clock signal input to the print element substrate a predetermined number of times.

8. The substrate according to claim 1, wherein the determining unit includes, a filter having a predetermined passband with respect to the temperature signal output by the selecting unit, and a comparator configured to compare a signal via the filter with a predetermined threshold, and output a determination result signal based on a result of the comparison.

9. The substrate according to claim 8, wherein the predetermined time is determined based on a delay time caused by the filter.

10. The substrate according to claim 8, further comprising:

a receiving unit configured to externally receive the predetermined threshold and a latch signal; and a latching unit configured to latch, based on the latch signal, the predetermined threshold received by the receiving unit, wherein based on reception of the latch signal, the masking unit starts masking the determination result signal output from the determining unit.

11. The substrate according to claim 10, further comprising a driving unit configured to drive each heater by sequentially applying, to the heater, a first pulse for discharging a liquid from a corresponding one of nozzles and a second pulse which does not reach discharge, wherein the determination result signal output from the determining unit is masked during a predetermined time from a timing at which the first pulse is driven.

12. A printhead that includes at least one print element substrate, wherein the print element substrate includes:

a plurality of heaters and a plurality of temperature sensors provided in correspondence with a plurality of nozzles;

a selecting unit configured to select one temperature sensor from the plurality of temperature sensors and output a temperature signal, and change the temperature sensor;

a determining unit configured to determine a discharge state of the nozzle based on the temperature signal output by the selecting unit;

an outputting unit configured to, based on a determination result output from the determining unit, externally output a signal indicating the discharge state of the nozzle corresponding to the temperature sensor selected by the selecting unit; and a masking unit configured to, in accordance with a change of the temperature sensor by the selecting unit, mask the determination result output from the determining unit to the outputting unit for a predetermined time after the change of the temperature sensor.

13. The printhead according to claim 12, wherein the predetermined time is determined based on a delay time caused by the determining unit.

14. The printhead according to claim 12, wherein the determination result output from the determining unit to the outputting unit is removed by the masking unit for the predetermined time.

15. An image forming apparatus that includes at least one printhead with a print element substrate, wherein the print element substrate includes:

a plurality of heaters and a plurality of temperature sensors provided in correspondence with a plurality of nozzles;

a selecting unit configured to select one temperature sensor from the plurality of temperature sensors and output a temperature signal, and change the temperature sensor;

a determining unit configured to determine a discharge state of the nozzle based on the temperature signal output by the selecting unit;

an outputting unit configured to, based on a determination result output from the determining unit, externally output a signal indicating the discharge state of the nozzle corresponding to the temperature sensor selected by the selecting unit; and a masking unit configured to, in accordance with a change of the temperature sensor by the selecting unit, mask the determination result output from the determining unit to the outputting unit for a predetermined time after the change of the temperature sensor.

16. The image forming apparatus according to claim 15, wherein the predetermined time is determined based on a delay time caused by the determining unit.

17. The image forming apparatus according to claim 15, wherein the determination result output from the determining unit to the outputting unit is removed by the masking unit for the predetermined time.

* * * * *